United States Patent [19]

Matsuyama

[11] 3,981,431

[45] Sept. 21, 1976

[54] BLANK FOR A SIMULATED JEWEL BOX

[75] Inventor: Glen Matsuyama, Los Angeles, Calif.

[73] Assignee: Graphic Arts Packaging Corporation, Gardena, Calif.

[22] Filed: May 22, 1975

[21] Appl. No.: 579,787

[52] U.S. Cl. ..... 229/34 HW; 229/8

[51] Int. Cl.[2] ..... B65D 5/22

[58] Field of Search ..... 229/33, 34, 34 HW, 8

[56] References Cited

UNITED STATES PATENTS

| | | | |
|---|---|---|---|
| 2,283,950 | 5/1942 | Ringler | 229/34 HW |
| 2,588,377 | 3/1952 | Frankenstein | 229/33 |
| 2,603,405 | 7/1952 | Frankenstein | 229/33 X |
| 2,765,113 | 10/1956 | Williamson | 229/34 HW |
| 3,124,293 | 3/1964 | Transport | 229/34 HW |
| 3,401,865 | 9/1968 | Holstrom | 229/34 HW |
| 3,765,598 | 10/1973 | Rosenburg, Jr. | 229/34 HW |
| R21,158 | 7/1939 | Frankenstein | 229/34 HW |

*Primary Examiner*—Davis T. Moorhead
*Attorney, Agent, or Firm*—Keith D. Beecher

[57] ABSTRACT

A one-piece blank is provided which may be composed of paperboard, or other suitable material, and which is used to form a simulated jewel box. The resulting box has a top and bottom which are identical with one another and which are hinged to one another along one edge. The box has a generally rectangular configuration with tapered corners to simulate the shape of a conventional type of jewel box.

1 Claim, 4 Drawing Figures

TOP
BOTTOM
22'
40'
40'A
16'
16'A
Hinge

TOP
BOTTOM
20'
20'A
12'
12'A
50'
50'A
52'
52'A
42'
42'A
48'
48'A
54'
54'A
10'
10'A
14'
14'A

BLANK FOR A SIMULATED JEWEL BOX

BACKGROUND OF THE INVENTION

The one-piece blank of the invention is appropriately shaped, slit, perforated and scored so that it may be folded into the desired configuration in a suitable folding and gluing machine. When folded, the entire external surface of the box corresponds to one side only of the blank, so that appropriate decorative and informative information may be printed on the blank by a single one-sided printing operation.

The resulting box may be made with a minimum of gluing operations, and yet the box is sturdy and strong, and it is capable of relatively rough usage without tearing, crushing or losing its shape.

DETAILED DESCRIPTION OF THE ILLUSTRATED EMBODIMENT

Figures 1, 2:
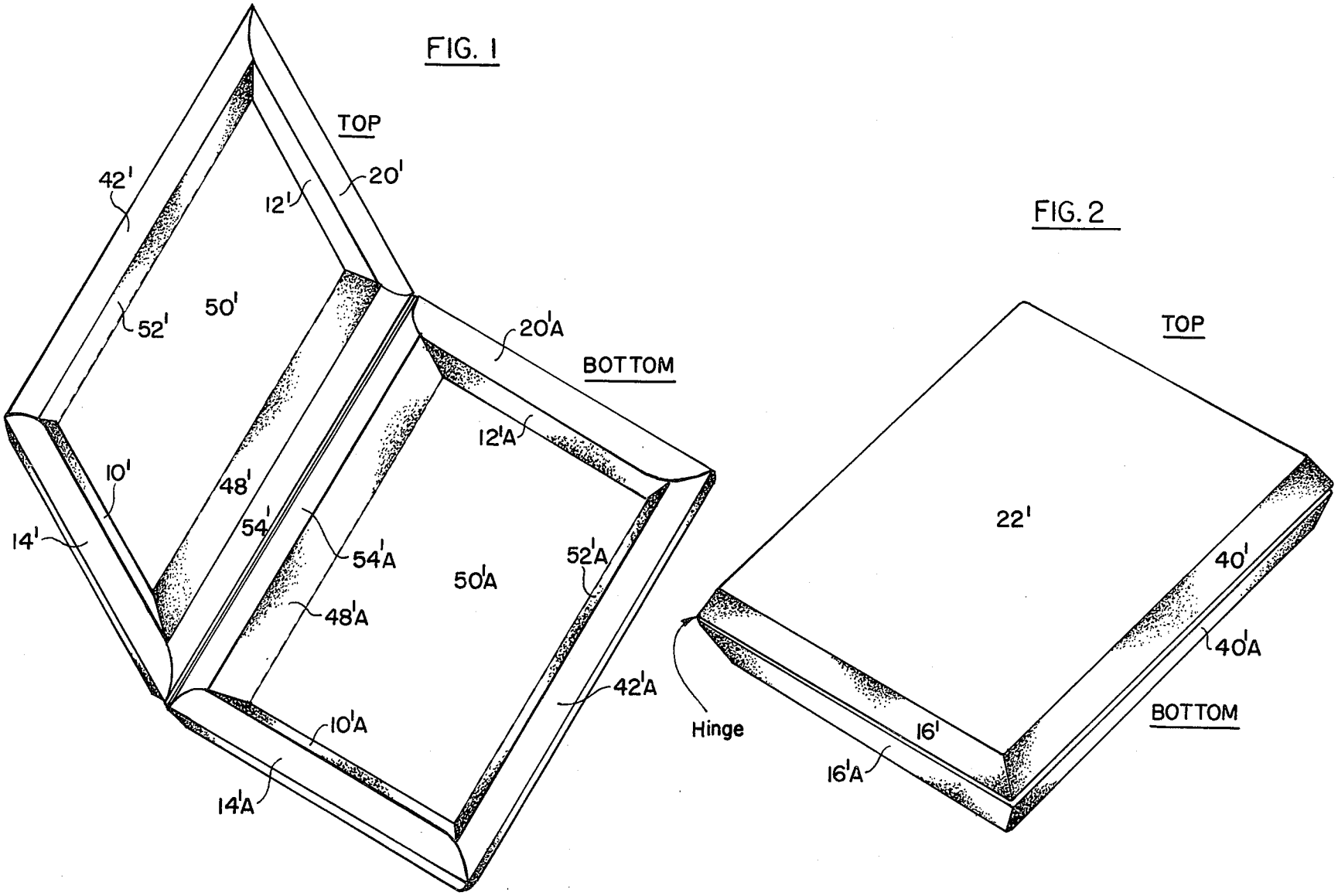
FIG. 1 is a perspective representation of a box constituting one embodiment of the invention, the box being shown in an open condition.
FIG. 2 is a perspective view, like FIG. 1, but with the box closed.

The box of FIGS. 1 and 2, as shown, simulates in its appearance a jewel box, and it constitutes an identical top and bottom which are hinged together along one edge. The resulting box is sturdy and strong, and, as noted above, is capable of relatively rough usage.

Figure 3:
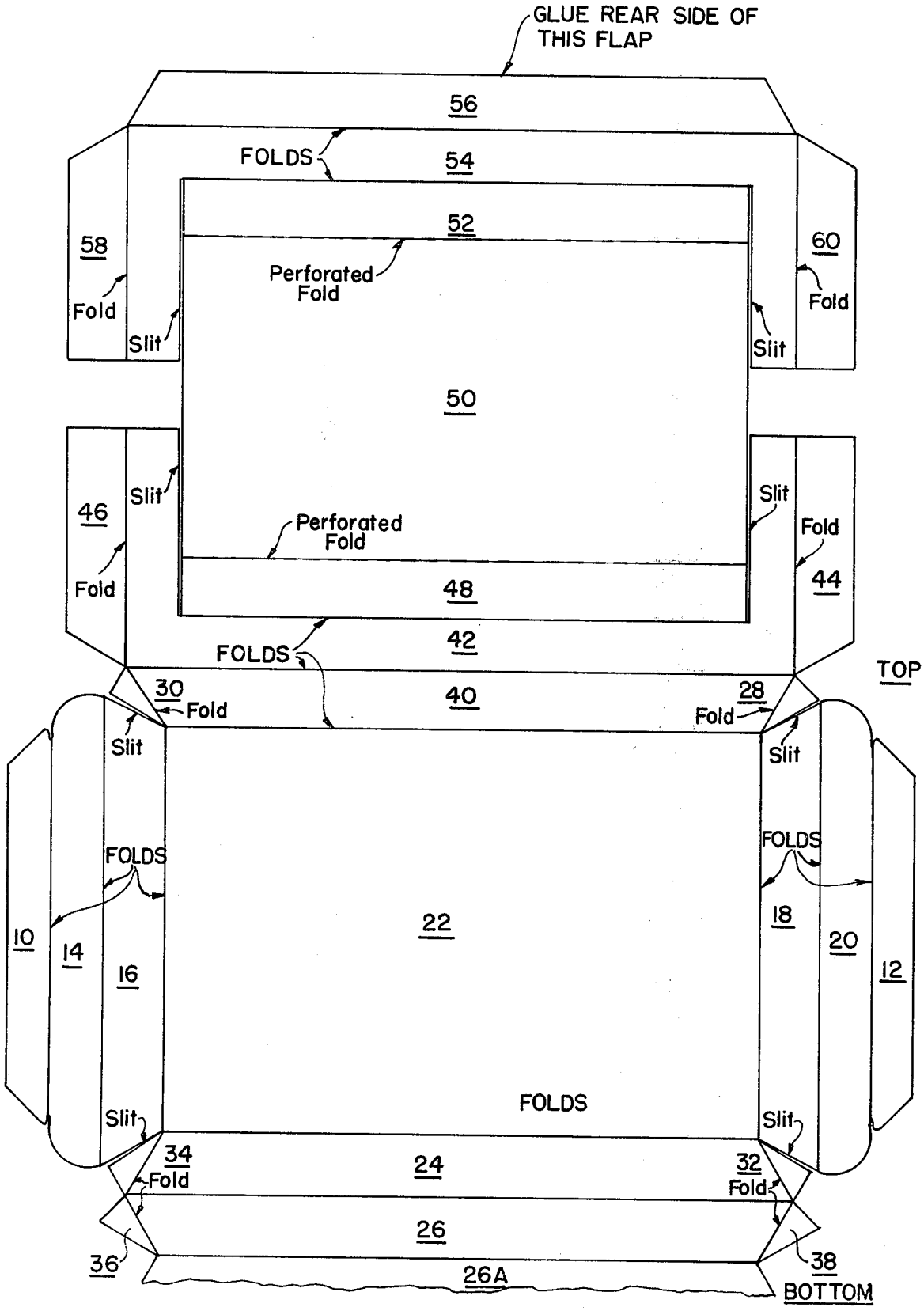
FIG. 3 is a top plan view of an appropriate blank, formed of paperboard, or other suitable material, and which may be folded to constitute either the top or bottom of the box of FIG. 1, it being understood that a similar blank is formed integral with the bottom of the blank of FIG. 3 to constitute the other portion of the box, with the scoreline between the two blanks constituting the hinge between the top and the bottom.
Figure 4:
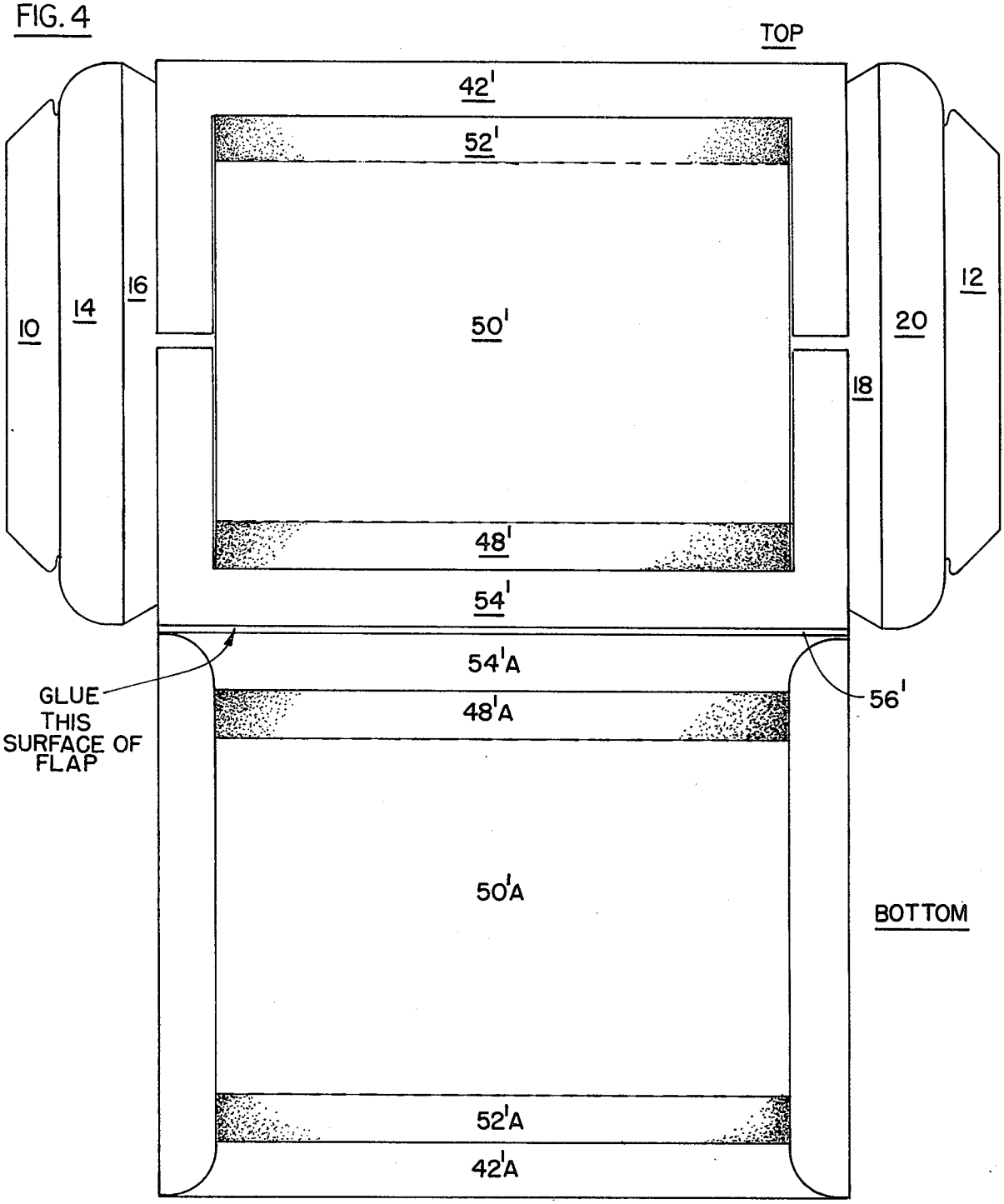
FIG. 4 is a view of the box of FIGS. 1 or 2 in a partially assembled condition.

The box of FIGS. 1 and 2 is formed of a single one-piece blank, one-half of which is shown in FIG. 3, it being understood that the other half of the blank is identical, and that one-half of the blank forms the top of the box and the other half forms the bottom.

The blank shown in FIG. 3 includes a first panel 50 and a second panel 22, each of generally rectangular shape. A first pair of end flaps 54 and 56 are formed integral with the panel 50, and the end flaps are separated from the panel 50 and from one another by appropriate scorelines designated "folds" in the drawings.

A second pair of end flaps 24 and 26 are formed integral with the second panel 22, and are separated therefrom and from one another by appropriate scorelines. A third pair of intermediate flaps 42 and 40 are formed integral with the first and second panels, and are separated therefrom and from one another by appropriate scorelines.

A pair of further panels 48 and 52 are formed at each end of the first panel respectively adjacent the flaps 42 and 54, and the latter panels are separated from the first panel 50 by appropriate scorelines which may, in each instance, be formed by a series of perforations extending across the panel 50.

The construction described above, permits the panel 50 to be folded into a shallow well against the panel 22, the opposite sides of the panels, flaps, and other components being shown as primed in FIG. 2. When the blank is folded into the form of FIG. 2, the flaps 42 and 54 form end margins for the well, whereas the flaps 52 and 48 form end walls for the well.

Side flaps 18, 20 and 12 are formed on one side of the panel 22, and respectively similar side flaps 16, 14 and 10 are formed on the other side. These latter side flaps are separated from the panel 22 and from one another by appropriate scorelines, so that the flaps of each group may be folded around one another to constitute side walls and side margins for the well, with the flaps 10 and 12 forming the side walls (as shown in FIG. 1), and with the flaps 20 and 14 forming the side margin.

Slots are provided at each end of the flaps 20 and 14, between the flaps and the respective flaps 12 and 10, to permit the side flaps to be interlocked into one another when folded into the configuration of FIG. 1.

It will be observed that the flaps 54 and 42 have side portions extending along the sides of the panel 50 and separated therefrom by respective slits. The flap 42 has additional side flaps 44 and 46 formed integral therewith and separated therefrom by appropriate scorelines, whereas the flap 54 has additional flaps 58 and 60 formed integral therewith and separated therefrom by appropriate scorelines.

The flaps 44 and 46, 60 and 58 are also folded into one another under the side flaps 18, 20, 12 and 10, 14 and 16 to constitute reinforcements for the side flaps. Gussets 28 and 30 are formed integral with the ends of the flap 40, and gussets 32 and 34 are formed integral with the ends of the flap 24, the gussets being separated from the corresponding flaps by appropriate scorelines, so that they may be folded over to enclose the corners of the box.

The blank shown in FIG. 3 may be formed to constitute the top of the box, as explained above, and an identical blank, integral with the blank of FIG. 3, may be used to form the bottom. The various components of the latter blank are designated by the same numbers and primes as the former blank, with the addition of the letter A.

As shown in FIG. 3, the outer intermediate flap of the latter blank, designated 26A is formed integral with the outer intermediate flap 26 of the former blank. These two flaps are integral with one another, and are separated by an appropriate scoreline which constitutes the hinge of the box.

In assembling the box, the flap 56 extends down between the flaps 26 and 26A, and the flap 56 is glued to the surface of the flap 26A, which constitutes the only required gluing operation, although the bottom of the panel 50 may be glued to the top of the panel 22 if so desired.

The invention provides, therefore, a one-piece blank which may be used to form a box by means of a variety of folding operations, and with a minimum of gluing.

It will be appreciated that although a particular embodiment of the invention has been shown and described, modifications may be made, and it is intended in the following claims to cover the modifications which come within the spirit and scope of the invention.

What is claimed is:

1. A one-piece blank for forming a generally rectangular box having identical top and bottom sections hinged to one another along a common edge, the blank including: a first rectangular panel and a second rectangular panel; a first pair of end flaps integral with the first panel and separated therefrom and from one another by respective scorelines; a second pair of end flaps integral with the second panel and separated therefrom and from one another by respective scorelines; a third pair of intermediate flaps integral with the first and second panels and separated therefrom and from one another by respective scorelines to permit the first panel to be folded over the second panel; a pair of further panels formed at each end of the first panel respectively adjacent to one of the flaps of the first pair and one of the flaps of the third pair and separated from the first panel by respective scorelines to permit the first panel to be moved into a shallow rectangular well against the second panel with the last-named flaps of the first and third pairs forming end rims for the well and with the further panels forming end walls for the well; first and second pluralities of side flaps formed integral with the respective sides of the second panel and separated therefrom by respective scorelines to permit the side flaps of the first and second pluralities to be folded over one another to form side rims and side walls for the well; said one of the end flaps of said first pair and said one of the end flaps of said second pair having side sections extending along the respective sides of the first panel and separated therefrom by respective slits, each of said side sections having an integral flap separated therefrom by a scoreline to be folded under the side flaps of the first and second pluralities to constitute reinforcement for the side rims and side walls of the well; and an identical one-piece blank having first and second panels of rectangular shape, and a second pair of end flaps integral with the second panel thereof and separated therefrom and from one another by respective scorelines, and in which the other one of said last-named flaps is integral with the end flaps of the second panel of the first-named blank and separated therefrom by a scoreline, the first-named blank forming a top for the box and the second-named blank forming a bottom for the box, and said last-named scoreline forming a hinge for the top and bottom.

* * * * *